US008814325B2

(12) United States Patent
Furuta

(10) Patent No.: US 8,814,325 B2
(45) Date of Patent: Aug. 26, 2014

(54) PRINTING DEVICE AND PRINT HEAD

(71) Applicant: Seiko Epson Corporation, Tokyo (JP)

(72) Inventor: Tatsuo Furuta, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/933,715

(22) Filed: Jul. 2, 2013

(65) Prior Publication Data

US 2014/0009535 A1 Jan. 9, 2014

(30) Foreign Application Priority Data

Jul. 4, 2012 (JP) ..... 2012-150219

(51) Int. Cl.

| | |
|---|---|
| ***B41J 2/205*** | (2006.01) |
| ***B41J 2/15*** | (2006.01) |
| ***B41J 2/155*** | (2006.01) |
| *B41J 2/165* | (2006.01) |

(52) U.S. Cl.

CPC ..... *B41J 2/15* (2013.01); *B41J 2002/1655* (2013.01); *B41J 2/16585* (2013.01); *B41J 2/155* (2013.01); *B41J 2/16535* (2013.01)

USPC ..... 347/43

(58) Field of Classification Search

None

See application file for complete search history.

(56) References Cited

U.S. PATENT DOCUMENTS 6,325,489 B2 * 12/2001 Endo ..... 347/43
6,877,833 B2 * 4/2005 Teshigawara et al. ..... 347/15

FOREIGN PATENT DOCUMENTS

JP 2004-276387 A 10/2004

* cited by examiner

*Primary Examiner* — Lamson Nguyen

(74) *Attorney, Agent, or Firm* — Global IP Counselors, LLP

(57) ABSTRACT

A print head has a first nozzle row that discharges yellow ink, a second nozzle row that discharges cyan ink, a third nozzle row that discharges magenta ink, a fourth nozzle row arranged between the first nozzle row and the second nozzle row that discharges black ink, and a fifth nozzle row arranged between the second nozzle row and the third nozzle row that discharges black ink. The first to fifth nozzle rows are arranged in sequence of the first, fourth, second, fifth and third nozzle rows from the upstream side of the conveyance direction of the print medium to the downstream side, and each consists of a plurality of nozzles arranged in the width direction orthogonal to the conveyance direction, and ink is discharged on the conveyed print medium without scanning the print head.

5 Claims, 8 Drawing Sheets

PRINTING DEVICE AND PRINT HEAD

CROSS-REFERENCE TO RELATED APPLICATIONS

This application claims priority to Japanese Patent Application No. 2012-150219 filed on Jul. 4, 2012. The entire disclosure of Japanese Patent Application No. 2012-150219 is hereby incorporated herein by reference.

BACKGROUND

1. Technical Field

The present invention relates to technology for forming dots on a print medium to print an image.

2. Background Technology

From the past, printing devices have been used which are equipped with print heads capable of discharging four colors of ink: yellow, cyan, magenta, and black. Known as this kind of printing device are inkjet printers having print heads on which are arranged for each color nozzle rows for discharging the same color of ink. (See Patent Document 1.) In recent years, due to a demand for high resolution printing and high speed printing, the distance between nozzles within each nozzle row and the distance between nozzle rows has become very short.

Japanese Laid-open Patent Publication No. 2004-276387 (Patent Document 1) is an example of the related art.

SUMMARY

Problems to be Solved by the Invention

With the printing device that discharges four colors of ink noted above, when the distance between nozzles or the distance between nozzle rows is short, there is the risk of mixed colors occurring at the nozzles. For example, there is the risk of mixed colors occurring by paper dust adhering so that it covers either of two nozzles that are mutually adjacent and discharge respectively different colors, and the ink within one nozzle moving to the other nozzle via that paper dust. Also, mixed colors can occur by a portion of the discharged ink being in mist form, floating in the space between the print head and the print medium, and that mist form ink (ink mist) adhering to the discharge port of an adjacent nozzle of a different color. In particular, with a printer that performs printing one line at a time (dots aligned in the main scan direction) when conveying the print medium without performing a scan of the print head (also called a line printer), it is easy for mixed colors to occur between adjacent nozzle rows in the printing direction. In specific terms, mixed colors occur easily by ink mist discharged from a nozzle at the upstream side of the conveyance direction to adhere to the discharge port of the adjacent nozzle at the downstream side by the flow of air accompanying conveyance of the print medium.

In this way, when mixed colors of the ink occurs, the hue of the dots formed on the print medium differs from the planned hue of the dots, bringing a decrease in printing quality. In particular, when magenta which is relatively difficult for an observer to sense a difference in hue is mixed with yellow ink for which a difference in the hue is sensed relatively easily, the observer senses a big difference in the hue of the dots formed on the print medium.

The problem described above is not limited to printing devices having print heads that discharge only the four colors noted above (yellow, cyan, magenta, black), and can also occur with printing devices having print heads that discharge inks of five colors or more including the four colors noted above (e.g. yellow, cyan, magenta, black, light cyan, light magenta).

An advantage of the invention is to inhibit a decrease in printing quality due to mixed colors of ink with a printing device equipped with a print head that discharges a plurality of inks including at least yellow, cyan, magenta, and black.

Means Used to Solve the Above-Mentioned Problems

The invention was created to address at least a portion of the problems noted above, and can be realized as the following modes or application examples.

Application Example 1

A printing device equipped with a print head for discharging ink, wherein the print head has:

a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction, and discharge ink on the conveyed print medium without scanning of the print head.

With the printing device of application example 1, the nozzle rows that discharge black ink (fourth nozzle row and fifth nozzle row) are arranged between the first nozzle row and the second nozzle row, and between the second nozzle row and the third nozzle row, so it is possible to lengthen the distance between the two nozzle rows positioned sandwiching the nozzle rows that discharge black ink (first nozzle row and second nozzle row, second nozzle row and third nozzle row). Because of this, it is possible to inhibit the occurrence of mixed colors between two nozzle rows positioned to sandwich the nozzle rows that discharge black ink, possible to inhibit changes in the hue of the dots formed on the print medium (changes from the planned hue), and possible to inhibit a decrease in the printing quality. Also, with the printing device of application example 1, it is possible to make the distance between the first nozzle row and the second nozzle row, and the distance between the second nozzle row and the third nozzle row longer, so it is possible to inhibit the occurrence of mixed colors of yellow ink and cyan ink, mixed colors of cyan ink and magenta ink, and mixed colors of yellow ink and magenta ink. In addition, the first nozzle row of yellow ink is arranged furthest to the upstream side of the first through fifth nozzle rows, so it is possible to inhibit mixing of other color inks with the yellow ink. Typically, yellow ink is easier for an observer to sense a change of hue in compared to other colors, so by inhibiting mixed colors with the yellow ink, it is possible to greatly inhibit a decrease in printing quality. Also, if the sequence of brightness for the yellow and cyan and magenta colors is the sequence of yellow, cyan, and magenta, it is possible to arrange the brighter color ink nozzle row further to the upstream side, so the brighter the color, the more it is possible to reduce the possibility of other colors mixing in. Therefore, it is possible to inhibit a decrease in printing quality using this kind of constitution. Also, since with a so-called line printer like the printing device of application example 1, air flow (wind) occurs along the conveyance direction along with conveyance of the print medium, so it is easy for ink to move from the upstream side to the downstream side due to that flow of air. However, even in this case, with the constitution noted above, it is possible to inhibit the occurrence of mixed colors between the nozzle rows.

Application Example 2

The printing device according to application example 1, wherein the distances between adjacent nozzle rows with the first through fifth nozzle rows are all less than 200 micrometers.

With this kind of constitution, because between the nozzle rows is less than 200 micrometers, with printing devices for which mixed colors of ink occurs relatively easily, it is possible to inhibit the occurrence of mixed colors between the nozzle rows and to inhibit a decrease in printing quality.

Application Example 3

The print head of a printing device, having a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction in which the print medium is conveyed by the printing device in a state mounted in the printing device, and discharge ink on the conveyed print medium without scanning of the print head.

With the print head of application example 3, the nozzle rows that discharge black ink (fourth nozzle row and fifth nozzle row) are arranged between the first nozzle row and the second nozzle row, and between the second nozzle row and the third nozzle row, so it is possible to lengthen the distance between the two nozzle rows positioned sandwiching the nozzle rows that discharge black ink (first nozzle row and second nozzle row, second nozzle row and third nozzle row). Because of this, it is possible to inhibit the occurrence of mixed colors between two nozzle rows positioned to sandwich the nozzle rows that discharge black ink, possible to inhibit changes in the hue of the dots formed on the print medium (changes from the planned hue), and possible to inhibit a decrease in the printing quality. Also, with the printing device of application example 3, it is possible to make the distance between the first nozzle row and the second nozzle row, and the distance between the second nozzle row and the third nozzle row longer, so it is possible to inhibit the occurrence of mixed colors of yellow ink and cyan ink, mixed colors of cyan ink and magenta ink, and mixed colors of yellow ink and magenta ink. In addition, the first nozzle row of yellow ink is arranged furthest to the upstream side of the first through fifth nozzle rows, so it is possible to inhibit mixing of other color inks with the yellow ink. Typically, yellow ink is easier for an observer to sense a change of hue in compared to other colors, so by inhibiting mixed colors with the yellow ink, it is possible to greatly inhibit a decrease in printing quality. Also, if the sequence of brightness for the yellow and cyan and magenta colors is the sequence of yellow, cyan, and magenta, it is possible to arrange the brighter color ink nozzle row further to the upstream side, so the brighter the color, the more it is possible to reduce the possibility of other colors mixing in. Therefore, it is possible to inhibit a decrease in printing quality using this kind of constitution. Also, since with a so-called line printer, air flow (wind) occurs along the conveyance direction along with conveyance of the print medium, so it is easy for ink to move from the upstream side to the downstream side due to that flow of air. However, even in this case, by using the print head of application example 3 having the constitution noted above, it is possible to inhibit the occurrence of mixed colors between the nozzle rows.

Application Example 4

The print head according to application example 3, wherein the distances between adjacent nozzle rows with the first through fifth nozzle rows are all less than 200 micrometers.

With this kind of constitution, because between the nozzle rows is less than 200 micrometers, with print heads for which mixed colors of ink occurs relatively easily, it is possible to inhibit the occurrence of mixed colors between the nozzle rows and to inhibit a decrease in printing quality.

Application Example 5

A method of recording an image on a recording medium using a printing device having a print head that discharges ink, including:

(a) a step of conveying the recording medium with the printing device, and (b) a step of discharging ink from the print head on the conveyed recording medium, wherein the print head has a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction, and at step (b), the first through fifth nozzle rows each discharge ink on the conveyed print medium without scanning of the print head.

With the method of application example 5, the nozzle rows that discharge black ink (fourth nozzle row and fifth nozzle row) are arranged between the first nozzle row and the second nozzle row, and between the second nozzle row and the third nozzle row, so it is possible to lengthen the distance between the two nozzle rows positioned sandwiching the nozzle rows that discharge black ink (first nozzle row and second nozzle row, second nozzle row and third nozzle row). Because of this, it is possible to inhibit the occurrence of mixed colors between two nozzle rows positioned to sandwich the nozzle rows that discharge black ink, possible to inhibit changes in the hue of the dots formed on the print medium (changes from the planned hue), and possible to inhibit a decrease in the printing quality. Also, with the printing device of application example 5, it is possible to make the distance between the first nozzle row and the second nozzle row, and the distance between the second nozzle row and the third nozzle row longer, so it is possible to inhibit the occurrence of mixed colors of yellow ink and cyan ink, mixed colors of cyan ink and magenta ink, and mixed colors of yellow ink and magenta ink. In addition, the first nozzle row of yellow ink is arranged furthest to the upstream side of the first through fifth nozzle rows, so it is possible to inhibit mixing of other color inks with the yellow ink. Typically, yellow ink is easier for an observer to sense a change of hue in compared to other colors, so by inhibiting mixed colors with the yellow ink, it is possible to greatly inhibit a decrease in printing quality. Also, if the sequence of brightness for the yellow and cyan and magenta colors is the sequence of yellow, cyan, and magenta, it is possible to arrange the brighter color ink nozzle row further to the upstream side, so the brighter the color, the more it is possible to reduce the possibility of other colors mixing in. Therefore, it is possible to inhibit a decrease in printing quality using this kind of constitution. Also, since with a so-called line printer like that of the constitution used with the method of application example 5, air flow (wind) occurs along the conveyance direction along with conveyance of the print medium, so it is easy for ink to move from the upstream side to the downstream side due to that flow of air. However, even in this case, using the constitution noted above, it is possible to inhibit the occurrence of mixed colors between the nozzle rows.

The invention can be realized with various modes, for example it can be realized in a mode such as a print head unit, an ink discharging method or the like.

BRIEF DESCRIPTION OF THE DRAWINGS

Referring now to the attached drawings which form a part of this original disclosure.

DETAILED DESCRIPTION OF EXEMPLARY EMBODIMENTS

A. Embodiments

A1. Device Structure

Figure 1:
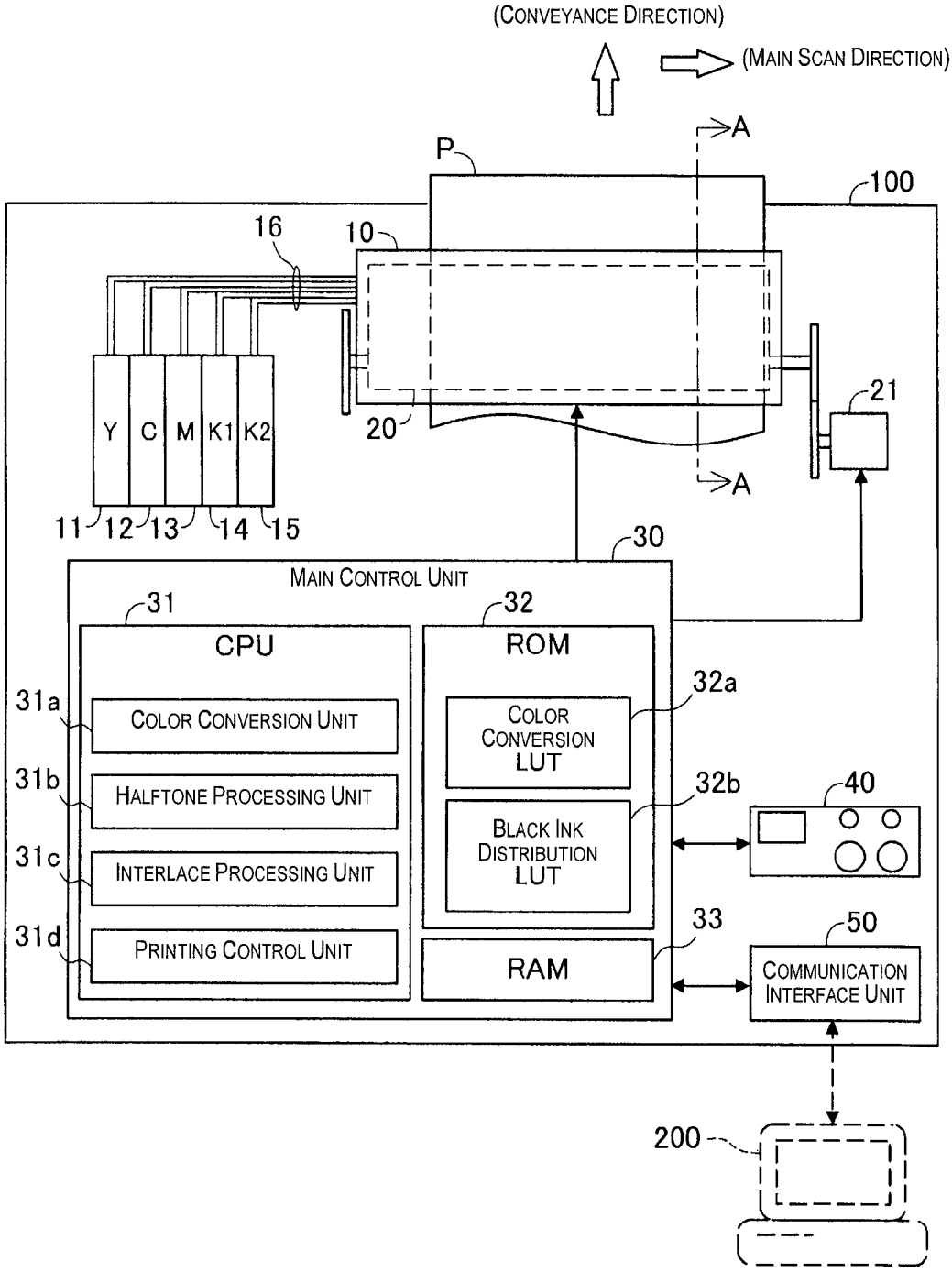
FIG. 1 is an explanatory drawing showing the schematic structure of a printing device as an embodiment of the invention.
Figure 2:
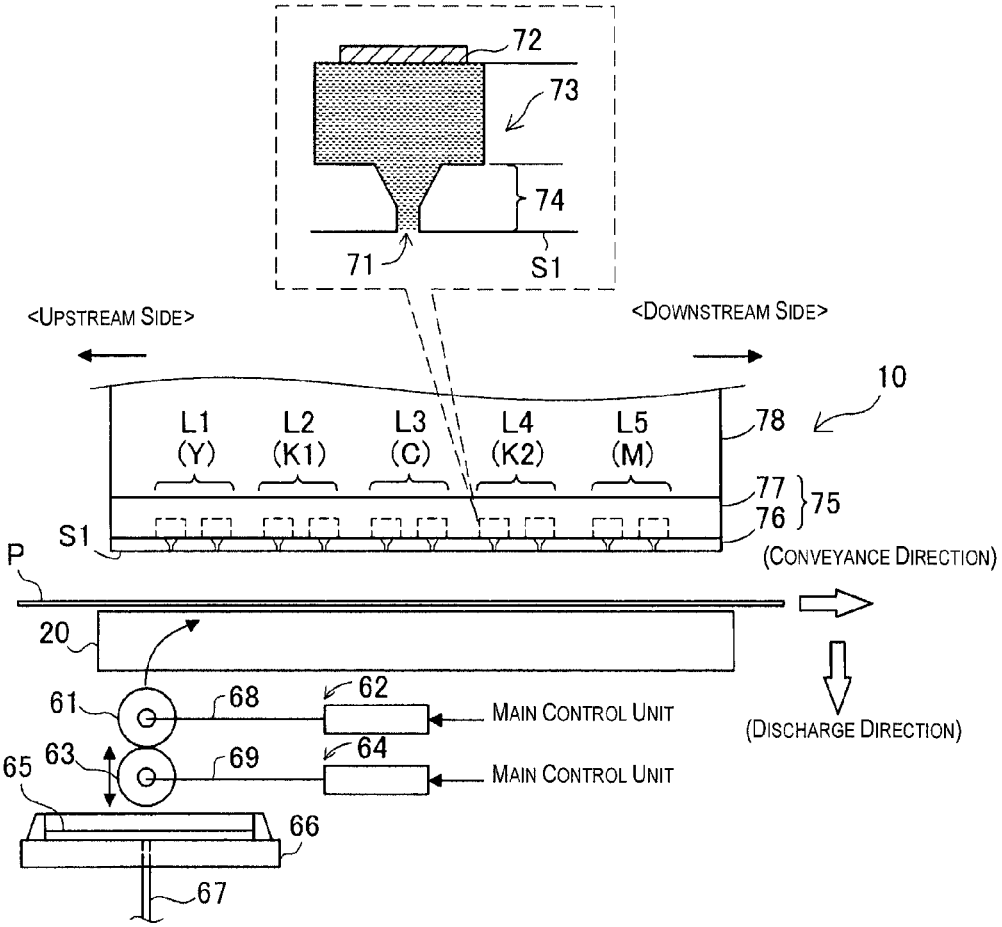
FIG. 2 is a cross section diagram typically showing the structure near the print head unit.
Figure 3:
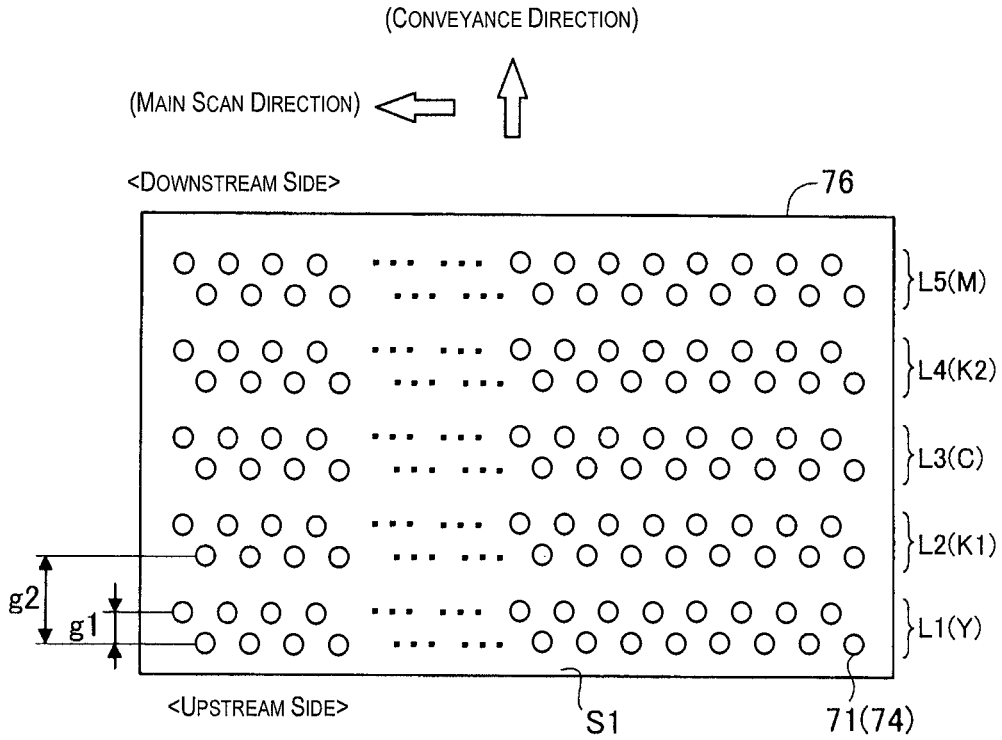
FIG. 3 is an explanatory drawing showing the surface on which the nozzle opening is provided with the print head.

FIG. 1 is an explanatory drawing showing the schematic structure of a printing device as an embodiment of the invention. FIG. 2 is a cross section diagram typically showing the structure near the print head unit. FIG. 3 is an explanatory drawing showing the surface on which the nozzle opening is provided with the print head. FIG. 2 typically shows the A-A cross section of FIG. 1.

As shown in FIG. 1, the printing device 100 is an inkjet printer that can perform image printing on a printing paper P using four colors of ink, and is equipped with a print head unit 10, a first ink tank 11, a second ink tank 12, a third ink tank 13, a fourth ink tank 14, a fifth ink tank 15, an ink supply tube 16, a platen 20, a conveyance motor 21, an operating unit 40, a communication interface unit 50, and a main control unit 30. Also, as shown in FIG. 2, the printing device 100 is equipped with a wiping roller 61, a first roller drive mechanism 62, an ink removing roller 63, a second roller drive mechanism 64, an ink receiving unit 66, and an ink exhaust tube 67.

With this embodiment, as the four colors of ink, three chromatic color inks and one achromatic color ink are used. In specific terms, as the chromatic inks, yellow colored ink (hereafter also called "Y ink"), cyan colored ink (hereafter also called "C ink"), and magenta colored ink (hereafter also called "M ink") are used. Also, as the achromatic ink, black colored ink is used. With this embodiment, for the sequence of brightness of the three types of achromatic colored inks (Y, M, C), Y ink has the highest brightness, M ink has the second level brightness, and C ink has the third level brightness. Here, "brightness" with this embodiment means the value representing brightness in a uniform color space, and for example means the L* value in an L*a*b* color system color space or an L*C*h color system color space.

As shown in FIG. 2, the print head unit 10 is equipped with a print head 75 and a flow path forming unit 78. The print head 75 is a so-called line head, and is equipped with a nozzle plate 76 and a discharge mechanism housing unit 77. Formed on the nozzle plate 76 is a nozzle row consisting of a plurality of nozzles 74 for discharging each color of ink (Y, C, M, black). In specific terms, as shown in FIG. 3, formed on the nozzle plate 76 are a first nozzle row L1 that discharges Y ink, a second nozzle row L2 that discharges black ink, a third nozzle row L3 that discharges C ink, a fourth nozzle row L4 that discharges black ink, and a fifth nozzle row L5 that discharges magenta ink. To distinguish between the respective black inks discharged from the second nozzle row L2 and the fourth nozzle row L4, hereafter, the black ink discharged from the second nozzle row L2 is called K1 ink, and the black ink discharged from the fourth nozzle row is called K2 ink.

The black ink has a thinner concentration of coloring agent per drop than the other colored inks, so it is necessary to discharge a large amount of ink. Also, the black ink has a high volume of usage volume (application volume) for the overall image, and the brightness is low, so when the discharge volume is low, the brightness rises for the overall image, and it is easy for insufficient usage volume (application volume) to stand out compared to other colors. Because of that, with this embodiment, two nozzle rows are used to discharge black ink.

Each of the nozzle rows L1 to L5 respectively consists of a plurality of nozzles 74 aligned along the main scan direction (conveyance direction of the printing paper P, specifically the direction orthogonal to the sub scan direction). The length of the main scan direction of each of the nozzle rows L1 to L5 is the same or greater than the length of the horizontal width of the printing paper P (length of the main scan direction). As shown in FIG. 3, each of the nozzle rows L1 to L5 is respectively constituted by two nozzle rows, but for convenience with the explanation, these two nozzle rows together are referred to as the Nth nozzle row LN (N is an integer of 1 to 5). As shown in FIG. 2 and FIG. 3, with this embodiment, the first nozzle row L1, the second nozzle row L2, the third nozzle row L3, the fourth nozzle row L4, and the fifth nozzle row L5 are arranged in that sequence facing the downstream side from the upstream side of the conveyance direction of the printing paper P. As shown in FIG. 1, the length of the main scan direction of each of the nozzle rows L1 to L5 is longer than the length of the horizontal width of the printing paper P.

As shown in FIG. 3, the distance g1 between the two nozzle rows constituting each nozzle row L1 to L5 is for example 60 micrometers or less, and the distance g2 between adjacent nozzle rows that discharge mutually different colored inks is for example 200 micrometers or less. Also, the nozzle pitch with each of the nozzle rows L1 to L5 is for example 1600 dpi.

A discharge mechanism housing unit 77 houses the mechanism for discharging ink from an opening 71 of the nozzle 74. In specific terms, as shown enlarged in FIG. 2, the discharge mechanism housing unit 77 houses a pressure chamber 73 and a piezo electric vibration element 72. The pressure chamber 73 is in communication with the nozzle 74, and is in contact with the piezo electric vibration element 72. With the pressure chamber 73, the wall that is in contact with the piezo electric vibration element 72 has flexibility. With this embodiment, the piezo electric vibration element 72 is a piezo element that is a capacitive load, and when voltage is applied between electrodes via a signal line (not illustrated), it bends and deforms the wall surface that is in contact with the pressure chamber 73. When pressure is applied to the pressure chamber 73 according to this deformation, the ink inside the pressure chamber 73 is discharged from the opening 71 via the nozzle 74.

Formed on the flow path forming unit 78 is an ink flow path for supplying ink to each pressure chamber 73. Also, housed in the flow path forming unit 78 are signal lines (not illustrated) for transmitting signals to each piezo electric vibration element 72, line buffers (not illustrated) prepared for each of the nozzle rows L1 to L5, or signal lines (not illustrated) for connecting that line buffer and the main control unit 30.

The first ink tank 11 accumulates the Y ink. Also, the second ink tank 12 accumulates the C ink, the third ink tank 13 accumulates the M ink, the fourth ink tank 14 accumulates the K1 ink, and the fifth ink tank 15 accumulates the K2 ink. Each ink tank 11 to 15 is arranged at a different location from the print head unit 10 on the printing device 100. The ink supply tube 16 connects each ink tank 11 to 15 and the print head 10. The ink accumulated in each of the ink tanks 11 to 15 is supplied to the print head unit 10 through an ink supply tube 16 by a pump (not illustrated). The ink supply tube 16 is a tube shaped member having flexibility, and for example is formed with rubber as a base material.

As shown in FIG. 2, the platen 20 is arranged at a position facing opposite the print head unit 10 (vertically downward position). As shown in FIG. 1, the platen 20 is connected to the conveyance motor 21, is driven by the conveyance motor 21, and conveys the printing paper P in the conveyance direction. The length of the main scan direction of the platen 20 is longer than the length of the horizontal width of the printing paper P.

The operating unit 40 is equipped with a monitor for displaying the operating buttons, various menu screens or the like. A communication interface unit 50 realizes an interface for the printing device 100 (main control unit 30) to perform communication with a personal computer 200. As this kind of interface, for example, it is possible to use USB (Universal Serial Bus), IEEE (Institute of Electrical and Electronic Engineers) 802.3 or the like.

As shown in FIG. 1, the main control unit 30 is equipped with a CPU (Central Processing Unit) 31, a ROM (Read Only Memory) 32, and RAM (Random Access Memory) 33, and is electrically connected to the print head unit 10 and the conveyance motor 21. The CPU 31 functions as a color conversion unit 31*a*, a halftone processing unit 31*b*, an interlace processing unit 31*c*, and a printing control unit 31*d* by expanding a control program stored in the ROM 32 and executing it. The color conversion unit 31*a* executes color conversion processing with the printing process described later. The halftone processing unit 31*b* executes halftone processing and black ink distribution rate determination processing with the printing process described later. The interlace processing unit 31*c* executes interlace processing with the printing process described later. The printing control unit 31*d* executes image printing by controlling the piezo electric vibration element 72 to discharge ink from the print head 75 with the printing process described later.

In addition to the previously described control program, stored in the ROM 32 in advance are a color conversion look up table (LUT) 32*a* and a black ink distribution look up table (LUT) 32*b*. The color conversion LUT 32*a* is a table that correlates input values of the R (red), G (green), and B (blue) format with output values of the Y (yellow), C (cyan), M (magenta), and K (black) format. The black ink distribution LUT 32*b* is described in detail hereafter.

The wiping roller 61 shown in FIG. 2 performs an operation of wiping (hereafter called "wiping operation") a surface S1 (hereafter called "nozzle opening surface S1") on which the opening 71 is formed on the nozzle plate 76, and removes ink adhered to the nozzle opening surface S1. The wiping operation will be described in detail later. The wiping roller 61 has a round cylinder shape extending in the main scan direction, and is constituted to be able to rotate with the axis along the main scan direction as the center. Also, the wiping roller 61 is constituted to be able to move in the vertical direction and the conveyance direction. In FIG. 2, the wiping roller 61 is arranged at the initial position. As shown in FIG. 2, with this embodiment, the initial position of the wiping roller 61 is vertically below the platen 20 (side facing opposite the print head 75, sandwiching the platen). As the initial position, it is possible to use a position that is further to the downstream side of the conveyance direction than the end of the downstream side of the print head 75, or a position that is further to the upstream side of the conveyance direction than the end of the upstream side of the print head 75. The length of the main scan direction of the wiping roller 61 is longer than the length of the main scan direction of each nozzle row L1 to L5, and it is possible to wipe all the nozzles constituting each nozzle row L1 to L5. The surface of the wiping roller 61 is covered by a material that can absorb ink. As this kind of material, for example it is possible to use a nonwoven cloth such as felt or the like.

The first roller drive mechanism 62 has a first support member 68 and a motor (not illustrated) or the like, and is mechanically connected to the wiping roller 61. The first support member 68 supports both ends of the shaft of the wiping roller 61. The first support member 68 is driven by a motor (not illustrated) or the like, and realizes the rotation operation of the wiping roller 61 itself with the shaft of the wiping roller 61 as the center, or movement of the wiping roller 61 in the vertical direction and the horizontal direction. The first roller drive mechanism 62 is electrically connected to the main control unit 30, and realizes the movement of the wiping roller 61 (rotation and movement) during the wiping operation described later following instructions from the main control unit 30.

The ink removing roller 63 wrings out ink absorbed in the wiping roller 61 from the wiping roller 61 by rotating while contacting the wiping roller 61. The ink removing roller 63 has a cylinder shape extending in the main scan direction, and for example is formed using a metal material such as stainless steel or the like. The ink removing roller 63 can perform a rotation operation with the shaft along the main scan direction as the center, and movement operation in the vertical direction.

The second roller drive mechanism 64 has a second support member 69 and a motor (not illustrated) or the like, and is mechanically connected to the ink removing roller 63. The second support member 69 supports both ends of the shaft of the ink removing roller 63. The second support member 69 is driven by the motor (not illustrated) or the like, and realizes the rotation operation of the ink removing roller 63 itself with the shaft of the ink removing roller 63 as the center, or movement in the vertical direction of the ink removing roller 63. The second roller drive mechanism 64 is electrically connected to the main control unit 30, and realizes the rotation operation and movement operation of the ink removing roller 63 according to instructions from the main control unit 30.

The ink receiving unit 66 is positioned vertically downward in relation to the ink removing roller 63, and receives ink removed from the wiping roller 61. The ink receiving unit 66 has a dish shape at which the surface facing the ink removing roller 63 is opened, and has a sheet shaped ink absorbing material 65 on the bottom part. The ink absorbing material 65 absorbs ink removed from the wiping roller 61. An ink exhaust tube 67 is arranged in contact with the ink absorbing material 65 piercing the bottom of the ink receiving unit 66, and sends the ink absorbed in the ink absorbing material 65 to a waste ink tank (not illustrated). The ink exhaust tube 67 is formed using a tube shaped member having flexibility similar to the ink supply tube 16.

The printing device 100 having the constitution described above has nozzle rows that discharge achromatic (K1, K2) ink arranged between the nozzle rows that discharge chromatic (Y, C, M) inks, so the generation of mixed colors between the chromatic inks is inhibited. In addition, of the chromatic inks, the brighter colored inks are arranged further to the upstream side in the conveyance direction of the printing paper P, so it is possible to inhibit the occurrence of mixed colors at the brighter colored ink nozzles. A more detailed description of the effect of the invention will be given later.

Also, the printing device 100 is able to inhibit degradation of the printing quality due to mixed colors with the black ink by executing a black ink distribution rate determination process described later. Also, the printing device 100 is able to inhibit a decrease in printing quality due to mixed colors that come with the wiping operation by executing a wiping process described later.

A2: Printing Process

Figure 4:
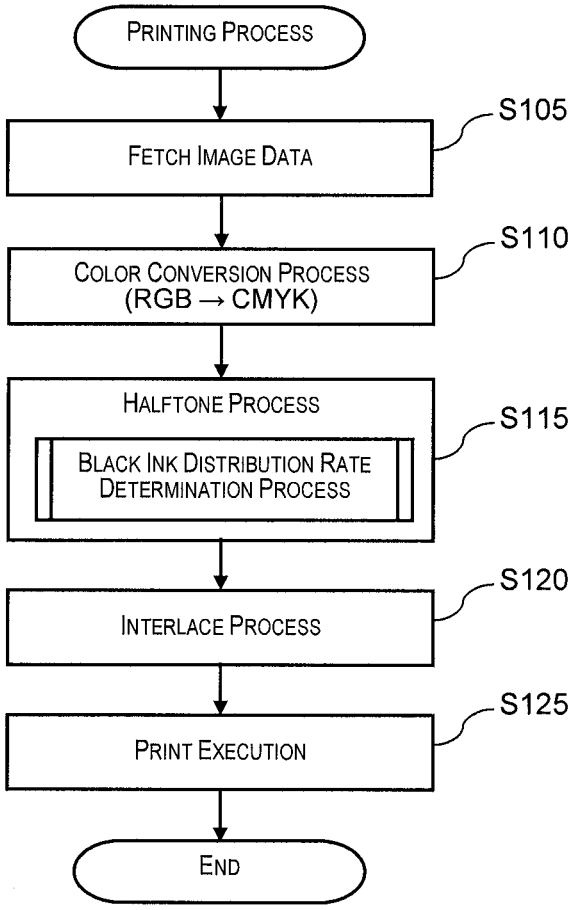
FIG. 4 is an explanatory drawing showing the printing process procedure executed with the printing device 100.

FIG. 4 is an explanatory drawing showing the procedure of the printing process executed with the printing device 100. With the printing device 100, when the print job data from the personal computer 200 shown in FIG. 1 is received, the printing process starts. In addition to image data consisting of each tone value of red (R), green (G), and blue (B), the print job data sent from the personal computer 200 contains the parameters of the print resolution and printing speed specified by the user. With this embodiment, as the print resolution, values in the range of 300 dpi to 1800 dpi can be specified, and as the printing speed, values in the range of 30 ppm to 60 ppm can be specified. However, the invention is not limited to these numerical value ranges, and it is possible to use any numerical value range as the print resolution and printing speed range.

As shown in FIG. 4, the printing control unit 31*d* fetches image data contained in the print job data (step S105).

The color conversion unit 31*a* references the color conversion LUT 32*a* and converts the image data fetched at step S105 to ink color image data (step S110). In specific terms, image data consisting of each tone value of red (R), green (G), and blue (B) (0 to 255) is converted to image data consisting of each tone value of Y (yellow), C (cyan), M (magenta), and K (black) (0 to 255).

The halftone processing unit 31*b* executes halftone processing and converts the image data converted to ink colors to dot on and off data (step S115). This halftone processing includes the black ink distribution rate determination process described later, and the halftone processing unit 31*b* executes the black ink distribution rate determination process as part of step S115.

The interlace processing unit 31*c* performs interlace processing that changes the alignment of the dot pattern printed with one row (one line), and transfers the obtained data to a line buffer (not illustrated) (step S120).

By sending print head drive signals to the print head unit 10, the printing control unit 31*d* discharges ink from the print head 75 and controls the conveyance motor 21 to convey the printing paper P to execute image printing (step S125). With the print head unit 10, when the print head drive signals are received from the printing control unit 31*d*, each of the piezo electric vibration elements 72 are driven according to data prepared in the line buffer (not illustrated), and ink is discharged from each nozzle 74.

A3. Black Ink Distribution Rate Determination Process

Figure 5:
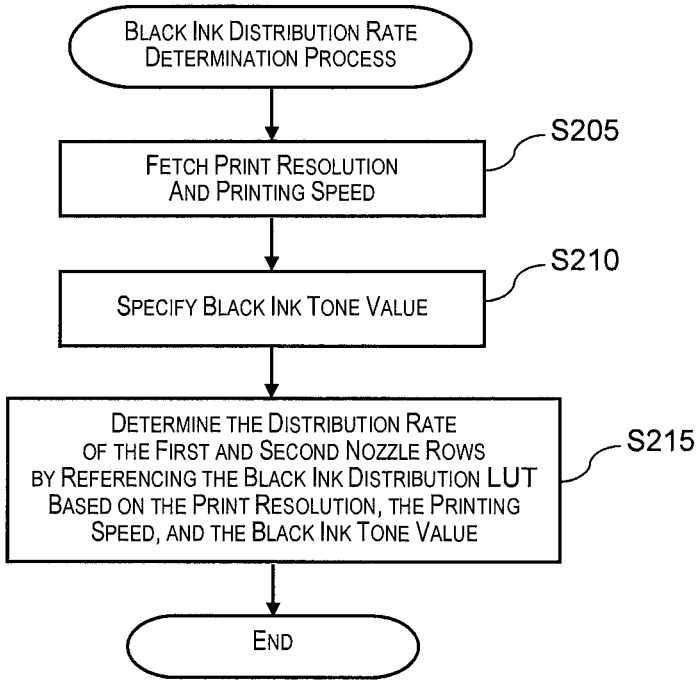
FIG. 5 is a flow chart showing the procedure of the black ink distribution rate determination process executed at step S115 shown in FIG. 4.

FIG. 5 is a flow chart showing the procedure of the black ink distribution rate determination process executed at step S115 shown in FIG. 4. The black ink distribution rate determination process is a process for determining the distribution rate of the ink volume discharged by the second nozzle row L2 (K1 ink volume) and the ink volume discharged by the fourth nozzle row L4 (K2 ink volume) of the black ink volume correlating to the black ink tone values obtained at step S110.

The halftone processing unit 31*b* fetches each value of the print resolution and printing speed contained in the print job data (step S205). At step S205, the conveyance direction resolution is fetched as the print resolution. Next, the halftone processing unit 31*b* specifies the blank ink tone value obtained at step S110 for each pixel (S210).

The halftone processing unit 31*b* determines the K1 ink and K2 ink distribution rate (S215) by referencing the black ink distribution LUT 32*b* based on each value of the print resolution and the printing speed fetched at step S205 and on the black ink tone value specified at step S210. The K1 ink and K2 ink distribution rate means the ratio at which each respective ink is distributed when distributing the black ink volume to be discharged into the volume of black ink discharged from the second nozzle row L2 (K1 ink) and the volume of black ink discharged from the fourth nozzle row L4 (K2 ink).

Figure 6:
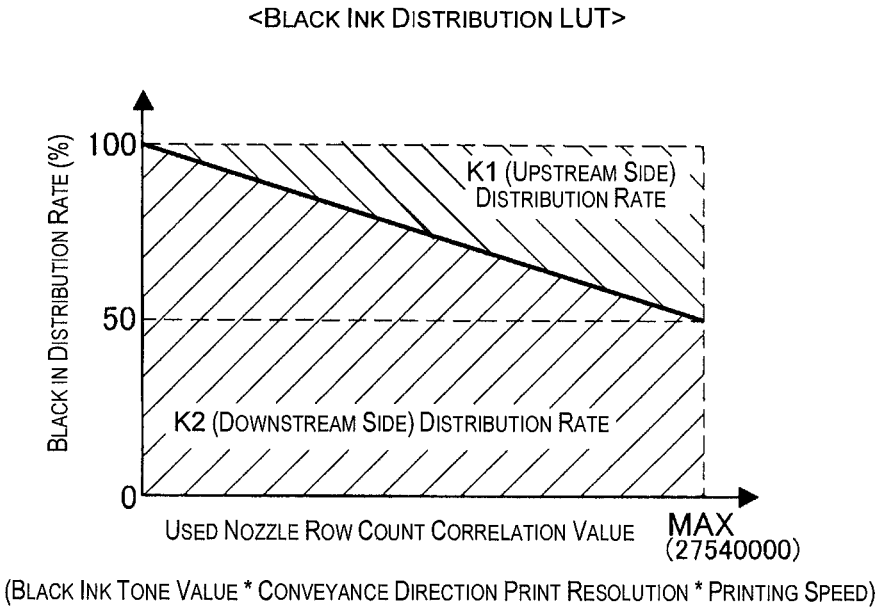
FIG. 6 is an explanatory drawing showing the setting contents of the black ink distribution LUT 32*b* shown in FIG. 1.

FIG. 6 is an explanatory drawing showing the setting contents of the black ink distribution LUT 32*b* shown in FIG. 1. In FIG. 6, the horizontal axis shows the used nozzle row count correlation value, and the vertical axis show the ink distribution rate (%). The used nozzle row count correlation value is a value correlating to the number of nozzle rows used for discharging black ink, and with this embodiment, a value obtained by multiplying the black ink tone value (gray scale), the conveyance direction resolution, and the printing speed is used.

When the black ink tone value is high, the number of nozzle rows used for ink discharge is a total of two, the second nozzle row L2 and the fourth nozzle row L4. In contrast to this, when the black ink tone value is low, the number of nozzle rows used for black ink discharge is one (one is sufficient). Therefore, the black ink tone value and the used nozzle count correlate to each other. Similarly, the number of nozzle rows used for ink discharge when the conveyance direction resolution is high is two, and the number of nozzle rows used when the conveyance direction resolution is low is one (one is sufficient). Therefore, the conveyance direction resolution and the used nozzle count correlate to each other. Also, when the printing speed is high, the number of nozzle rows used for ink discharge is two, and when the printing speed is low, the number of nozzle rows used for ink discharge is one (one is sufficient). Therefore, the printing speed and the used nozzle count correlate to each other. In this way, the used nozzle row count correlation value which is a value for which the number of nozzles used for black ink discharge, and the correlating three parameters (black ink tone value, conveyance direction resolution, printing speed) are respectively multiplied by each other correlates to the number of nozzle rows used for discharging black ink.

The minimum value of the used nozzle row count correlation value is 0 when each value of the black ink tone value, the conveyance direction resolution, and the printing speed are the minimum values (respectively 0, 300 (dpi), 30 (ppm)). Also, the maximum value of the used nozzle row count correlation value is 27540000 when each value of the black ink tone value, the conveyance direction resolution, and the printing speed are the maximum values (respectively 255, 1800 (dpi), 60 (ppm)).

As shown in FIG. 6, with the black ink distribution LUT 32*b*, the ink distribution rate of the K1 ink has a linear correlation to the used nozzle row count correlation value. In specific terms, for the ink distribution rate of the K2 ink, when the used nozzle row count correlation value is the minimum value (0), a minimum value of (0%) is set, and when the used nozzle row count correlation value is the maximum value (27540000), a minimum value of (50%) is set, with setting such that the ink distribution rate increases as the used nozzle row count correlation value increases.

Similarly, with the black ink distribution LUT 32*b*, the ink distribution rate of the K2 ink has a linear correlation to the used nozzle row count correlation value. In specific terms, for the ink distribution rate of the K2 ink, when the used nozzle row count correlation value is the minimum value (0), a maximum value of (100%) is set, and when the used nozzle row count correlation value is the maximum value (2754000), a minimum value of (50%) is set, with the ink distribution rate set so as to decrease as the used nozzle row count correlation value increases. Therefore, regardless of the size of the used nozzle row count correlation value, the K2 ink distribution rate is set to the K1 ink distribution rate or greater.

Also, with the black ink distribution LUT 32*b*, the lower the used nozzle row count correlation value, the smaller the K1 ink distribution rate is in relation to the K2 ink distribution rate. Therefore, the lower the used nozzle row count correlation value, the smaller the relative volume of the discharge volume of K1 ink in relation to the discharge volume of the K2 ink. Said another way, if the black ink tone value and the conveyance direction resolution are the same, the lower the printing speed, the smaller the relative volume of the discharge volume of K1 ink in relation to the discharge volume of K2 ink. Also, if the black ink tone value and the printing speed are the same, the lower the conveyance direction resolution, the smaller the relative volume of discharge volume of K1 ink in relation to the discharge volume of K2 ink. Also, if the conveyance direction resolution and the printing speed are the same, the lower the black ink tone value, the smaller the relative volume of the discharge volume of K1 ink in relation to the discharge volume of K2 ink.

By using the black ink distribution LUT 32*b* set in this way, in cases when it is sufficient to use a relatively low nozzle row count for discharging black ink (when the black ink tone value is low, when the conveyance direction resolution is low, and when the printing speed is low), it is possible to lower the discharge volume of the K1 ink discharged from the upstream side (discharge value correlating to the discharge volume of the K2 ink of the downstream side), and it is possible to inhibit mixing of the black ink that moves from the upstream side to the downstream side with other inks. In addition, when a relatively large number for the nozzle row count for discharging black ink is needed (when the black ink tone value is high, when the conveyance direction resolution is high, and when the printing speed is high), it is possible to increase the discharge volume of the K1 ink discharged from the upstream side (discharge volume correlating to the discharge volume of the K2 ink of the downstream side). Because of this, a large volume of black ink is discharged using the two nozzle rows L2 and L4, and it is possible to realize high tone value dot formation, high resolution printing, or high speed printing.

Figure 7:
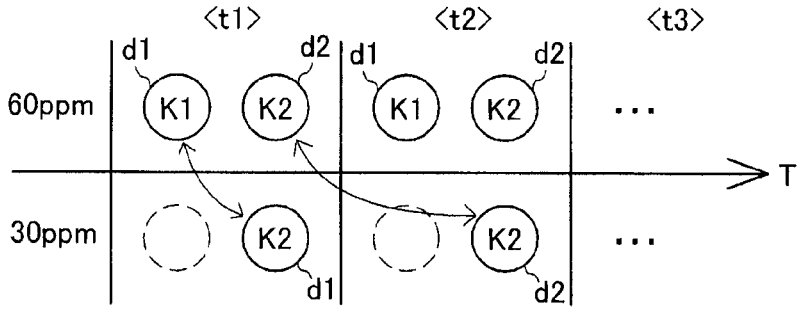
FIG. 7 is an explanatory drawing typically showing an example of the print processing results.

FIG. 7 is an explanatory drawing typically showing an example of the print processing results. In FIG. 7, the horizontal axis indicates the elapsed time T. Also, in FIG. 7, the upper level typically shows the dot forming status when the printing speed is 60 ppm (maximum value), and the lower level typically shows the dot forming status when the printing speed is 30 ppm (minimum value).

As shown in the upper level of FIG. 7, when the printing speed is 60 ppm, at time t1, two dots d1 and d2 are formed. In this case, the dot d1 is formed by K1 ink discharged from the second nozzle row L2, and the dot d2 is formed by the K2 ink discharged from the fourth nozzle row L4. Similarly, when the printing speed is 60 ppm, at time t2, a dot d3 is formed by the K1 ink, and a dot d4 is formed by the K2 ink. In this way, when the printing speed is 60 ppm, the K1 ink distribution rate and the K2 ink distribution rate at times t1 and t2 are both 50%.

As shown in the lower level of FIG. 7, when the printing speed is 30 ppm, the dot d1 is formed at time t1 and the dot d2 is formed at time t2. The dots d1 and d2 indicate dots of the same position as the dots d1 and d2 when the printing speed is 60 ppm. The two dots d1 and d2 when the printing speed is 30 ppm are both formed by the K2 ink. In this way, when the printing speed is 30 ppm, at times t1 and t2, the K1 ink distribution rate is 0%, and the K2 ink distribution rate is 100%. As can be understood from these examples, with this embodiment, by determining the black ink distribution rate using the black ink distribution LUT 32*b*, it is possible to make the ink discharge volume from the second nozzle row L2 the same or less than the ink discharge volume from the fourth nozzle row L4.

Figure 8:
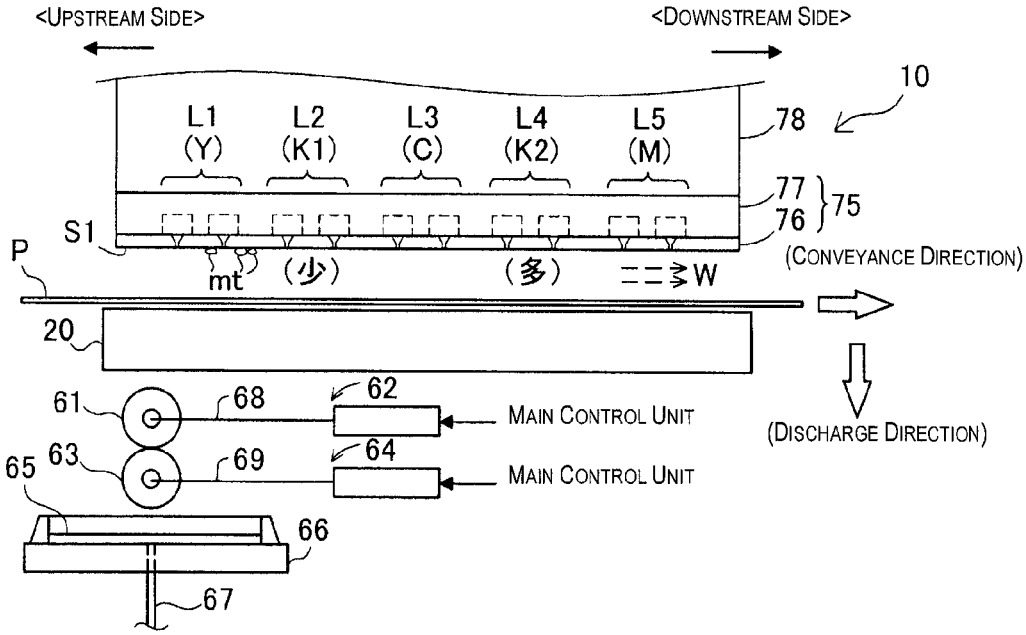
FIG. 8 is a cross section diagram for explaining an example of the effect of the printing device 100 of this embodiment.

FIG. 8 is a cross section diagram for explaining an example of the effect of the printing device 100 of this embodiment. With FIG. 8, the same as with FIG. 2, the A-A cross section shown in FIG. 1 with the printing device 100 is shown. As shown in FIG. 8, at the nozzle opening surface S1, a mist ink drop mt generated from the Y ink is adhered between the first nozzle row L1 and the second nozzle row L2. Also, along with conveyance of the printing paper P, a flow of air W is generated along the conveyance direction between the nozzle opening surface S1 and the printing paper P.

The mist form ink that is generated from the Y ink discharged from the first nozzle row L1 flows to the downstream side along the air flow W. Here, with the printing device 100, the second nozzle row L2 that discharges the K1 ink is arranged between the first nozzle row L1 that discharges the Y ink and the third nozzle row L3 that discharges the C ink, so distance in the conveyance direction between the first nozzle row L1 and the third nozzle row L3 is long. Because of this, as with the ink drop mt shown in FIG. 8, the mist form ink generated from the Y ink has a low possibility of adhering near the third nozzle row L3 even if it adheres between the first nozzle row L1 and the second nozzle row L2. Therefore, mixed colors of the Y ink and the C ink is inhibited, and it is possible to inhibit having a big difference between the dot hue and the planned dot hue. Also, since the constitution is such that the conveyance direction distance between the first nozzle row L1 and the third nozzle row L3 is long, the paper dust generated by conveyance of the printing paper P or the like is inhibited from covering either the opening of the first nozzle row L1 or the opening of the third nozzle row L3. Because of that, it is possible to inhibit the occurrence of mixed colors by mixing of the ink of the first nozzle row L1 and the ink of the third nozzle row L3 via the paper dust. The results described above are not limited to between the first nozzle row L1 and the third nozzle row L3, but are also exhibited between the first nozzle row L1 and the fifth nozzle row L5, and between the third nozzle row L3 and the fifth nozzle row L5.

Also, the first nozzle row L1 is arranged at the furthest upstream position of the nozzle rows L1 to L5, so it is possible to inhibit ink that flows from the upstream side by the air flow W from adhering to the first nozzle row L1 (opening 71), and to inhibit the other color inks from the upstream side from flowing into the first nozzle row L1 via paper dust. Therefore, it is possible to inhibit other inks from mixing in the Y ink for which there is the greatest sense of change of use due to mixed colors of the Y ink, the C ink, and the M ink, and to inhibit a decrease in printing quality. Also, it is possible to inhibit mixing of black ink (K1 ink and K2 ink) in the Y ink which has the highest brightness among the Y ink, the C ink, and the M ink, so it is possible to inhibit a decrease in the printing quality due to the brightness of the dots formed on the print medium from being lower (darker) than the planned brightness of the dots.

Also, of the two rows that discharge black ink, the second nozzle row L2 and the fourth nozzle row L4, the ink discharge volume from the second nozzle row L2 positioned further upstream is reduced, so it is possible to inhibit adhering of black ink on the opening of the third nozzle row L3 and the fifth nozzle row L5 positioned further to the downstream side than the second nozzle row L2 or the fourth nozzle row L4 due to the air flow W. Therefore, it is possible to inhibit a decrease in the printing quality due to the brightness of the dots formed on the print medium from being lower (darker) than the planned dot brightness by mixing of black ink in the C ink or the M ink.

A4. Wiping Process

Figure 9:
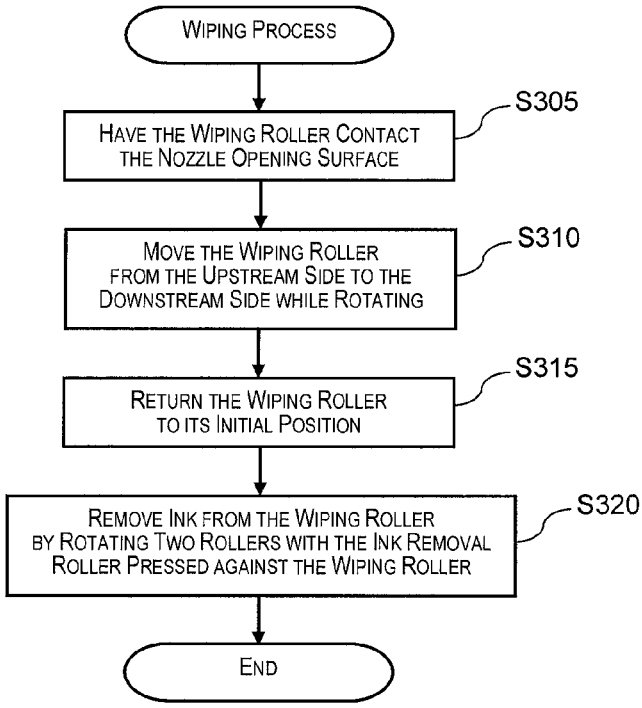
FIG. 9 is a flow chart showing the wiping process procedure executed with the printing device 100.
Figure 10:
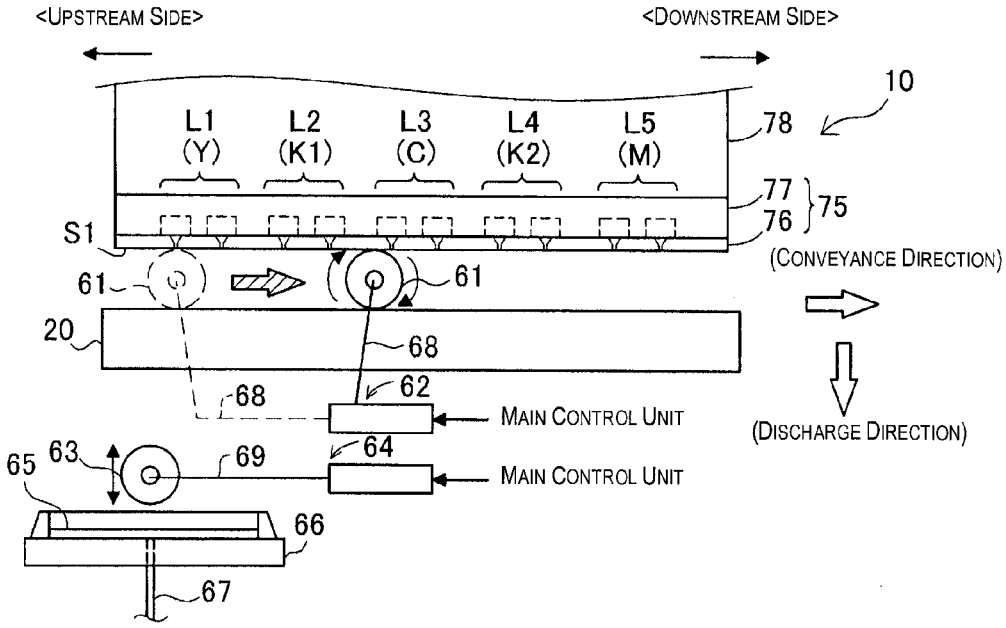
FIG. 10 is an explanatory drawing showing an example of the operation (wiping operation) of the wiping roller 61 during wiping process execution.

FIG. 9 is a flow chart showing the wiping process procedure executed with the printing device 100. FIG. 10 is an explanatory drawing showing an example of the operation (wiping operation) of the wiping roller 61 during wiping process execution. With the printing device 100, when wiping process execution instructions are input from the operating unit 40, the wiping process is executed. The wiping process is a process by which the wiping roller 61 performs a wiping operation and the ink drops and the like adhered to the nozzle opening surface S1 are wiped off.

As shown in FIG. 9, the printing control unit 31*d* controls the first roller drive mechanism 62, moves the wiping roller 61 vertically upward from the initial position, and puts it in contact with the nozzle opening surface S1 (step S305). The printing control unit 31*d* controls the first roller drive mechanism 62, and while rotating the wiping roller 61, moves it from the upstream side of the conveyance direction to the downstream side (step S310).

As shown in FIG. 10, at step S310, the wiping roller 61 moves along the conveyance direction while staying in contact with the nozzle opening surface S1. Therefore, of the five nozzle rows L1 to L5, the opening of the first nozzle row L1 is contacted first by the wiping roller 61, and after that the wiping roller 61 contacts them in the sequence of the opening of the second nozzle row L2, the opening of the third nozzle row L3, the opening of the fourth nozzle row L4, and the opening of the fifth nozzle row L5. With this kind of wiping roller 61 wiping operation, the ink drops and paper dust adhered near the openings of each nozzle row L1 to L5 are absorbed and removed by the wiping roller 61. As described previously, moving the wiping roller 61 from the upstream side of the conveyance direction toward the downstream side is to inhibit supplying of ink adhered near the opening of the downstream side nozzle rows to the openings of the upstream side nozzle rows via the wiping roller 61.

When the wiping roller 61 reaches the downstream side end of the conveyance direction of the nozzle opening surface S1, the printing control unit 31*d* controls the first roller drive mechanism 62 and returns the wiping roller 61 to its initial position (step S315).

The printing control unit 31*d* controls the second roller drive mechanism 64 and moves the ink removing roller 63 vertically upward and presses it on the wiping roller 61, and also controls the first roller drive mechanism 62 to rotate the wiping roller 61, and also, by controlling the second roller drive mechanism 64 and rotating the ink removing roller 63, removes the ink absorbed in the wiping roller 61 (step S320). The ink removed at step S320 is temporarily absorbed in the ink absorbing material 65 within the ink receiving unit 66, and after that, is exhausted from the ink exhaust tube 67.

With the printing device 100 of this embodiment described above, with the print head 75, the nozzle rows K1 and K2 that discharge achromatic ink (black ink) are arranged between the nozzle rows L1, L3, and L5 that discharge chromatic ink, so it is possible to make the distance between the chromatic ink nozzle rows longer. Therefore, it is possible to inhibit the occurrence of mixed colors by the chromatic inks moving from the upstream side to the downstream side by the air flow W generated by the conveyance of the printing paper P and having that enter the opening of the nozzle rows that discharge the other chromatic inks. Also, it is possible to make the distance between the chromatic ink nozzle rows longer, so it is possible to inhibit adhering of paper dust such that it covers the openings of two mutually different chromatic ink nozzle rows. Therefore, it is possible to inhibit movement of the chromatic ink via that paper dust and to inhibit the occurrence of mixed colors between chromatic inks. In this way, it is possible to inhibit the occurrence of mixed colors between chromatic inks, so it is possible to inhibit changes in the hue of dots formed by chromatic inks (change in hue when compared to the planned dot), and possible to inhibit a decrease in the printing quality. In particular, of the chromatic inks, the Y ink nozzle row which is the easiest to sense changes of hue in is arranged furthest to the upstream side among the five nozzle rows L1 to L5, so it is possible to inhibit mixing of other chromatic inks that have moved from the upstream side to the downstream side into the Y ink. Therefore, it is possible to significantly inhibit a decrease in printing quality.

In addition, with the printing device 100, among the chromatic inks, the brighter ink nozzle rows are arranged further to the upstream side, so the brighter the ink of the nozzle, the more it is possible to inhibit mixing of black ink along with the air flow W. By doing this, the brightness of the dots formed on the printing paper P becoming darker than the planned brightness is inhibited, and it is possible to inhibit a decrease in printing quality.

Also, with the printing device 100, two nozzle rows that discharge black ink are provided, and adjustment is done so that the volume discharged by the nozzle row (second nozzle row L2) positioned further to the upstream side is less than the volume discharged by the nozzle row (fourth nozzle row L4) positioned further to the downstream side, so it is possible to inhibit mixing in of black ink into the yellow ink which is the brightest, and it is possible to inhibit mixed colors of black ink into the cyan ink which is the second brightest. In addition, the discharge volume of the K1 ink and the discharge volume of the K2 ink are adjusted so that the lower the used nozzle row count correlation value, the lower the distribution rate of the K1 ink is in relation to the distribution rate of the K2 ink, so when it is sufficient to use a relatively low number of nozzle rows that discharge black ink, the discharge volume of the K1 ink discharged from the upstream side is lowered, and it is possible to inhibit mixing of black ink that moves to the downstream side in with other color inks, and also when it is necessary to have a relatively large number of nozzle rows that discharge black ink, a large volume of black ink is discharged using two nozzle rows L2 and L4, and it is possible to realize high tone value dot formation, high resolution printing, and high speed printing.

Also, with the wiping process, the wiping roller 61 is moved toward the downstream side from the upstream side of the conveyance direction while staying in contact with the nozzle opening surface S1, so it is possible to inhibit the ink adhered at or near the opening of the nozzle row positioned at the downstream side from entering into the opening of the nozzle row positioned at the upstream side via the wiping roller 61. As described above, the brighter ink nozzle rows are arranged further to the upstream side, so the brighter the ink nozzle row, the more it is possible to inhibit mixing in of black ink along with the wiping operation. By doing this, the brightness of the dots formed on the printing paper P are inhibited from becoming darker than the planned brightness, and it is possible to inhibit a decrease in the printing quality. Also, the Y ink nozzle row for which changes in hue is sensed the most is arranged at the furthest upstream side among the five nozzle rows L1 to L5, so it is possible to inhibit mixing in of other chromatic inks to the Y ink along with the wiping operation, and possible to significantly inhibit a decrease in printing quality.

B. Modification Examples

This invention is not limited to the embodiments and modes noted above, and can be implemented in various modes in a scope that does not stray from its gist, for example the following modifications are possible.

B1. Modification Example 1

With this embodiment, the brightness of the three types of chromatic ink were in sequence with the Y ink being the brightest, followed next by the C ink and then the M ink, but the invention is not limited to this. For example, it is also possible to have the Y ink be the highest, followed in sequence by the M ink and the C ink. With this constitution, of the chromatic inks, the nozzle row of the brighter ink can be arranged further to the upstream side. Because of that, the same as with the embodiment, the higher the brightness of the ink the nozzle row, the more it is possible to inhibit mixing in of black ink that comes with the air flow W and mixing in of black ink that comes with the wiping operation.

Also, with this embodiment, there were three types of chromatic ink, but the invention is not limited to that, and it is possible to use any number of types of chromatic ink. For example, it is possible to use a total of five types of chromatic ink with light cyan (Lc) ink and light magenta (Lm) ink added to the Y, C, and M inks described above.

Figure 11:
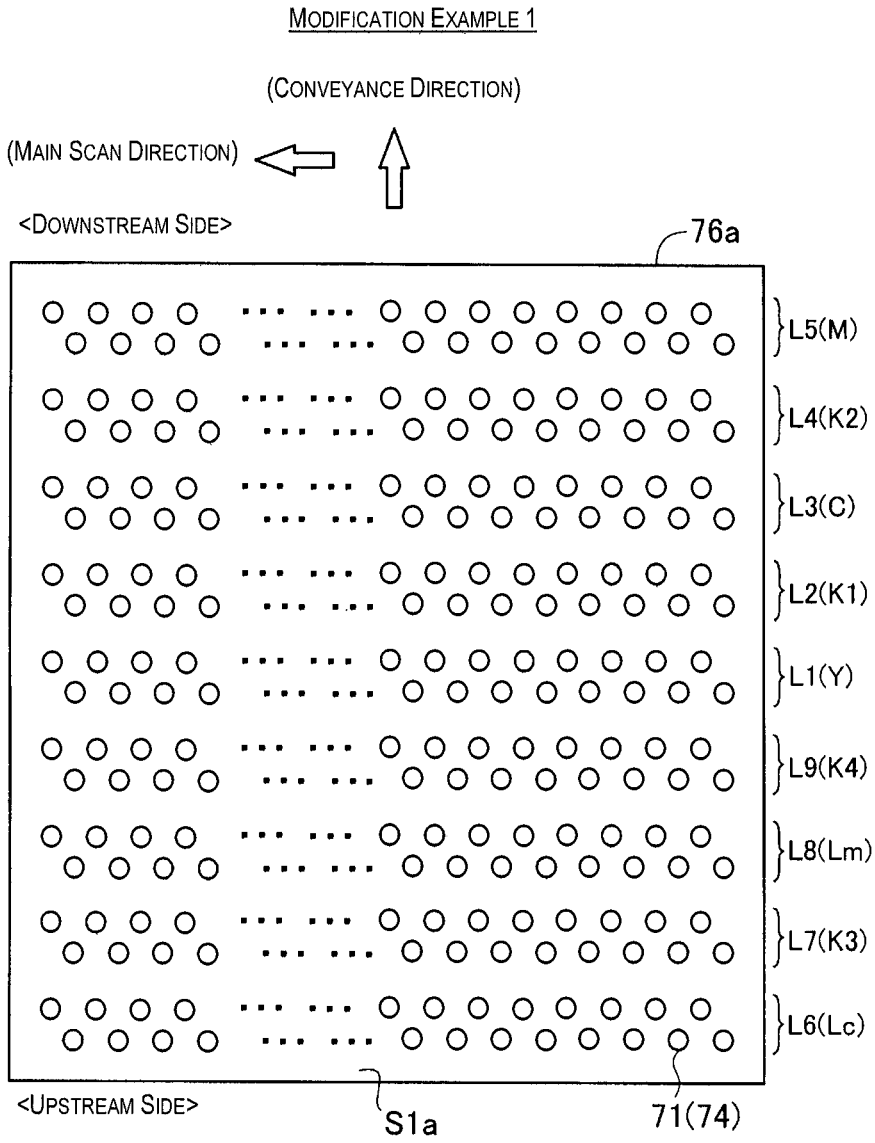
FIG. 11 is an explanatory drawing showing the nozzle opening surface S1a of modification example 1.

FIG. 11 is an explanatory drawing showing the nozzle opening surface S1a of modification example 1. The printing device of modification example 1 differs from the printing device of the embodiment noted above in that it discharges a total of five types of ink as the chromatic inks, including Y, C, M, Lc, and Lm, in that there is a total of four nozzle rows that discharge black ink, and in that the constitution is such that the print head 75 is able to discharge a total of six colors of ink, and the remainder of the constitution is the same as the printing device 100. The brightness of each chromatic ink used with modification example 1 is in the sequence of the Lc ink being the highest, followed in order by the Lm ink, the Y ink, the C ink, and the M ink.

As shown in FIG. 11, with the printing device of modification example 1, on the nozzle plate 76*a*, in addition to the five nozzle rows L1 to L5 described above, another four nozzle rows are equipped further to the upstream side from the first nozzle row L1. In specific terms, a sixth nozzle row L6 that discharges Lc ink, a seventh nozzle row L7 that discharges K3 ink, an eighth nozzle row L8 that discharged Lm ink, and a ninth nozzle row L9 that discharges K4 ink are equipped further to the upstream side than the first nozzle row L1. The K3 and K4 inks are black inks, the same as the K2 and K1 inks noted above. The arrangement sequence of these four nozzle rows L6 to L9 is in the sequence of the sixth nozzle row L6, the seventh nozzle row L7, the eight nozzle row L8, and the ninth nozzle row L9 facing from the upstream side of the conveyance direction to the downstream side.

The printing device of modification example 1 having this kind of constitution, the same as with the printing device 100 of the embodiment, is arranged so that the higher the brightness of the ink of the nozzle row, the further to the upstream side of the conveyance direction it is, so it has the same kind of effects as the embodiment noted above. With the constitution noted above, for the seventh nozzle row L7 and the ninth nozzle row L9, it is also possible to use a constitution for which they discharge gray ink rather than black ink.

B2. Modification Example 2

With the aforementioned embodiment and modification example 1, of the plurality of chromatic inks, the nozzle rows with the higher brightness inks were arranged further to the upstream side of the conveyance direction, but the invention is not limited to this. It is also possible to arrange the nozzle rows of the chromatic inks in any sequence along the conveyance direction. For example, the same as with the embodiment, with the constitution that discharges Y, C, and M inks, it is possible to arranged the C ink nozzle row furthest to the upstream side, and to arrange next in sequence the Y ink and M ink nozzle rows. With this constitution as well, by arranging black ink nozzle rows between the chromatic ink nozzle rows, it is possible to inhibit mixed colors between chromatic inks. In specific terms, it is possible to make the distance between the chromatic ink nozzle rows longer, so it is possible to inhibit adhering of paper dust across nozzles of different chromatic inks. Because of that, it is possible to inhibit the occurrence of mixed colors between chromatic inks via that paper dust.

When the chromatic ink nozzle rows are arranged in a sequence different from that of the embodiment noted above, with the wiping process, it is preferable to change the wiping operation sequence of the wiping roller 61 from that of the embodiment noted above. In specific terms, instead of having the nozzle row further to the upstream side wiped ahead in terms of time, it is preferable to perform the wiping operation in a sequence such as having the nozzle row with ink of higher brightness done ahead in terms of time. For example, as described above, when the C ink is arranged at the furthest upstream position, and the Y ink and M ink nozzle rows arranged next in sequence, it is preferable to perform the wiping operation in the sequence of the C ink nozzle row, the Y ink nozzle row, and the M ink nozzle row.

B3. Modification Example 3

With this embodiment, the ink discharged from a plurality of nozzle rows was black ink, but the invention is not limited to this. For example, instead of black ink, or in addition to black ink, it is also possible to discharge C ink or M ink using a plurality of nozzle rows. The C ink or the M ink have a thinner concentration of coloring agent per drop than the Y ink, so the same as with the black ink, it is necessary to have a larger discharge volume (application volume). With this constitution, it is preferable to determine the upstream side and downstream side distribution rate of the C ink or the M ink in the same way as the black ink with the embodiment noted above. Also, as with the modification example 1 noted above, with a constitution that discharges six colors (Y, C, M, K, Lc, Lm) of ink, it is also possible to discharge the Lc ink or the Lm ink which have a thinner concentration of coloring agent per drop than the other color inks using a plurality of nozzle rows. With this constitution, it is preferable to determine the upstream side and downstream side distribution rate for the Lc ink or the Lm ink in the same way as the black ink of the embodiment noted above.

With the embodiment noted above, the nozzle row that discharges black ink can be made to be only one of either the second nozzle row L2 or the fourth nozzle row L4. In this case as well, it is possible to make the distance between two nozzle rows sandwiching the nozzle row that discharges black ink longer, so it is possible to inhibit adhering of paper dust crossing between these two nozzle rows, and possible to inhibit the occurrence of mixed color via that paper dust. With this constitution, it is preferable to have this be only the second nozzle row L2 further to the upstream side. This is because of the chromatic inks, it is possible to make a larger distance between the first nozzle row L1 and the second nozzle row L2 that discharge the brighter two color inks (Y ink and C ink), and possible to inhibit changes in hue due to mixed colors with the brighter colors. Specifically, typically, it is possible to apply a printing device for which a nozzle row that discharges achromatic ink (black ink, gray ink or the like) is arranged between two nozzle rows that discharge mutually different types of chromatic ink for the printing device of the invention.

B4. Modification Example 4

With this embodiment, the invention was applied to so-called line printers with the nozzle rows arranged at the horizontal width of the printing paper P or greater along the main scan direction of the printing paper P, which perform printing without scanning the print head 75, but the invention is not limited to this. For example, as the print head, it is also possible to apply the invention to a serial printer having as the print head a so-called serial head that discharges ink while moving back and forth along the main scan direction of the printing paper P. With this constitution as well, by arranging the black ink nozzle row between the chromatic ink nozzle rows, it is possible to make the distance between the chromatic ink nozzle rows longer. Because of that, it is possible to inhibit the occurrence of mixed colors between chromatic inks via the paper dust.

B5. Modification Example 5

With this embodiment, the used nozzle row count correlation value used a value obtained by multiplying the black ink tone value (gray scale), the conveyance direction resolution, and the printing speed, but the invention is not limited to this. For example, it is also possible to use as the used nozzle row count correlation value any one of the values among the black ink tone value (gray scale), the conveyance direction resolution, and the printing speed, or a value obtained by multiplying any two values among these three values.

B6. Modification Example 6

With the embodiment noted above, during the wiping operation (step S310), the wiping roller 61 was rotated, but instead of this, it is also possible to not rotate it. In this case, it is preferable to change the surface in contact with the nozzle opening surface S1 and S1a by rotating the wiping roller 61 each time one wiping process is completed. Also, with the embodiment noted above, it was the wiping roller 61 that contacted the nozzle opening surface S1 and S1a, but the invention is not limited to this. For example, it is also possible to wipe ink drops adhered to the nozzle opening surface S1 by rubbing the nozzle opening surface S1 with a plate shaped member having elasticity (wiper blade).

B7. Modification Example 7

With the embodiment noted above, the ink discharge method was the so-called piezo method by which ink is discharged using the piezo electric vibration element 72, but instead of the piezo method, it is also possible to use the thermal method. Here, the thermal method is also called the bubble jet (registered trademark) method, and is a method that discharges ink by generating bubbles in the ink by heating.

B8. Modification Example 8

With the embodiment noted above, supplying of ink to the print head 75 was performed via the ink supply tube 16 via ink tanks 11 to 15 arranged at a separate location from the print head unit 10, but the invention is not limited to this. It is also possible to use a constitution by which a sub tank is arranged inside the print head unit 10, and ink is supplied to the print head 75 from that sub tank. With this constitution, as a method of supplying ink to the sub tank, for example, it is possible to use a method performed via the ink supply tube 16 from each ink tank 11 to 15 the same as with the embodiment noted above, a method of the user filling ink in the sub tank or the like. Also, it is possible to use a constitution with which an ink cartridge mounting unit is provided on the print head unit 10, ink cartridges of each ink color are mounted on the ink cartridge mounting unit, and ink is supplied to the print head unit 10 from those ink cartridges.

B9. Modification Example 9

With the embodiment noted above, it is also possible to replace a portion of the constitution realized using software with hardware. Conversely, it is also possible to replace a portion of the constitution realized using hardware with software.

What is claimed is:

1. A printing device equipped with a print head for discharging ink, wherein the print head has:

a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction, and discharge ink on the conveyed print medium without scanning of the print head.

2. The printing device according to claim 1, wherein the distances between adjacent nozzle rows with the first through fifth nozzle rows are all less than 200 micrometers.

3. The print head of a printing device, comprising a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction in which the print medium is conveyed by the printing device in a state mounted in the printing device, and discharge ink on the conveyed print medium without scanning of the print head.

4. The print head according to claim 3, wherein the distances between adjacent nozzle rows with the first through fifth nozzle rows are all less than 200 micrometers.

5. A method of recording an image on a recording medium using a printing device having a print head that discharges ink, comprising:

(a) conveying the recording medium with the printing device, and (b) discharging ink from the print head on the conveyed recording medium, wherein the print head has a first nozzle row consisting of a plurality of nozzles which discharge yellow ink, a second nozzle row consisting of a plurality of nozzles which discharge cyan ink, a third nozzle row consisting of a plurality of nozzles which discharge magenta ink, a fourth nozzle row consisting of a plurality of nozzles which discharge black ink, arranged between the first nozzle row and the second nozzle row, and a fifth nozzle row consisting of a plurality of nozzles which discharge black ink, arranged between the second nozzle row and the third nozzle row, wherein the first through fifth nozzle rows are each arrayed in the direction intersecting in relation to the conveyance direction of the print medium at the print head, and these are arranged in sequence of the first nozzle row, the fourth nozzle row, the second nozzle row, the fifth nozzle row, and the third nozzle row facing the downstream side from the upstream side of the conveyance direction, and the first through fifth nozzle rows each consist of a plurality of nozzles arranged in the width direction orthogonal to the conveyance direction, and at (b), the first through fifth nozzle rows each discharge ink on the conveyed print medium without scanning of the print head.

* * * * *